US010260339B2

(12) United States Patent
Corre

(10) Patent No.: US 10,260,339 B2
(45) Date of Patent: Apr. 16, 2019

(54) SYSTEMS AND METHODS FOR FORMATION SAMPLING

(71) Applicant: Schlumberger Technology Corporation, Sugar Land, TX (US)

(72) Inventor: Pierre-Yves Corre, Abbeville (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 198 days.

(21) Appl. No.: 15/278,063

(22) Filed: Sep. 28, 2016

(65) Prior Publication Data

US 2017/0089196 A1 Mar. 30, 2017

(30) Foreign Application Priority Data

Sep. 30, 2015 (EP) ..... 15290248

(51) Int. Cl.
*E21B 43/02* (2006.01)
*E21B 49/10* (2006.01)

(52) U.S. Cl.
CPC ..... *E21B 49/10* (2013.01)

(58) Field of Classification Search
CPC .... E21B 49/088; E21B 33/1216; E21B 43/02; E21B 49/10
See application file for complete search history.

(56) References Cited

U.S. PATENT DOCUMENTS 4,951,749 A 8/1990 Carroll
7,650,937 B2 1/2010 Fox et al.
8,453,725 B2 * 6/2013 Brennan, III ..... E21B 49/10 166/100
8,905,131 B2 12/2014 Brennan
2010/0071898 A1 3/2010 Corre et al.

OTHER PUBLICATIONS

Jackson, et al. "Specialized Techniques for Formation Testing and Fluid Sampling in Unconsolidated Formations in Deepwater Reservoirs," SPE 120443, 2009 SPE Middle East Oil & Gas Show and Conference held in the Bahrain International Exhibition Centre, Kingdom of Bahrain, Mar. 15-18, 2009, pp. 1-7.
Rollins, et al. Acquisition of Wireline Formation Test Tool Data From Unconsolidated Turbidite Sediments, Deepwater Gulf of Mexico, SPE Paper 24735, prepared for 67th Annual Technical Conference and Exhibition of the Society of Petroleum Engineers held in Washington, DC, Oct. 4-7, 1992, pp. 1-9.

* cited by examiner

*Primary Examiner* — Catherine Loikith
(74) *Attorney, Agent, or Firm* — Michael Dae

(57) ABSTRACT

A system includes a formation sampling tool having a body, a probe shoe extendibly mounted to the body, a packer coupled to the probe shoe, and an inlet fixedly coupled to the probe shoe and the packer. The packer surrounds the inlet and the inlet includes an anti-extrusion ring extending beyond an outer surface of the packer. The system also includes a filter disposed within the inlet.

16 Claims, 4 Drawing Sheets

SYSTEMS AND METHODS FOR FORMATION SAMPLING

CROSS REFERENCE TO RELATED APPLICATIONS

This application claims the benefit of European Application No. 15290248.2 filed on Sep. 30, 2015, incorporated by reference herein in its entirety.

BACKGROUND OF THE DISCLOSURE

Wellbores or boreholes may be drilled to, for example, locate and produce hydrocarbons. During a drilling operation, it may be desirable to evaluate and/or measure properties of encountered formations and formation fluids. In some cases, a drillstring is removed and a wireline tool deployed into the borehole to test, evaluate and/or sample the formations and/or formation fluid(s). In other cases, the drillstring may be provided with devices to test and/or sample the surrounding formations and/or formation fluid(s) without having to remove the drillstring from the borehole.

Formation evaluation may involve drawing fluid from the formation into a downhole tool for testing and/or sampling. Various devices, such as probes and/or packers, may be extended from the downhole tool to isolate a region of the wellbore wall, and thereby establish fluid communication with the subterranean formation surrounding the wellbore. Fluid may then be drawn into the downhole tool using the probe and/or packer. Within the downhole tool, the fluid may be directed to one or more fluid analyzers and sensors that may be employed to detect properties of the fluid while the downhole tool is stationary within the wellbore.

SUMMARY

The present disclosure relates to a system including a formation sampling tool having a body, a probe shoe extendibly mounted to the body, a packer coupled to the probe shoe, and an inlet fixedly coupled to the probe shoe and the packer. The packer surrounds the inlet and the inlet includes an anti-extrusion ring extending beyond an outer surface of the packer. The system also includes a filter disposed within the inlet.

The present disclosure also relates to a method including providing a formation sampling tool having a probe shoe extendibly mounted to a body of the formation sampling tool, a packer coupled to the probe shoe, an inlet fixedly coupled to the probe shoe and the packer. The packer surrounds the inlet and the inlet includes an anti-extrusion ring extending beyond an outer surface of the packer. The formation sampling tool also includes a filter disposed within the inlet. The method also includes positioning the formation sampling tool in a wellbore, extending the probe shoe toward a wall of the wellbore, contacting the outer surface of the packer against the wall of the wellbore, penetrating the wall of the wellbore with the anti-extrusion ring, collecting fluid from the wellbore through the inlet, and filtering the fluid using the filter.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
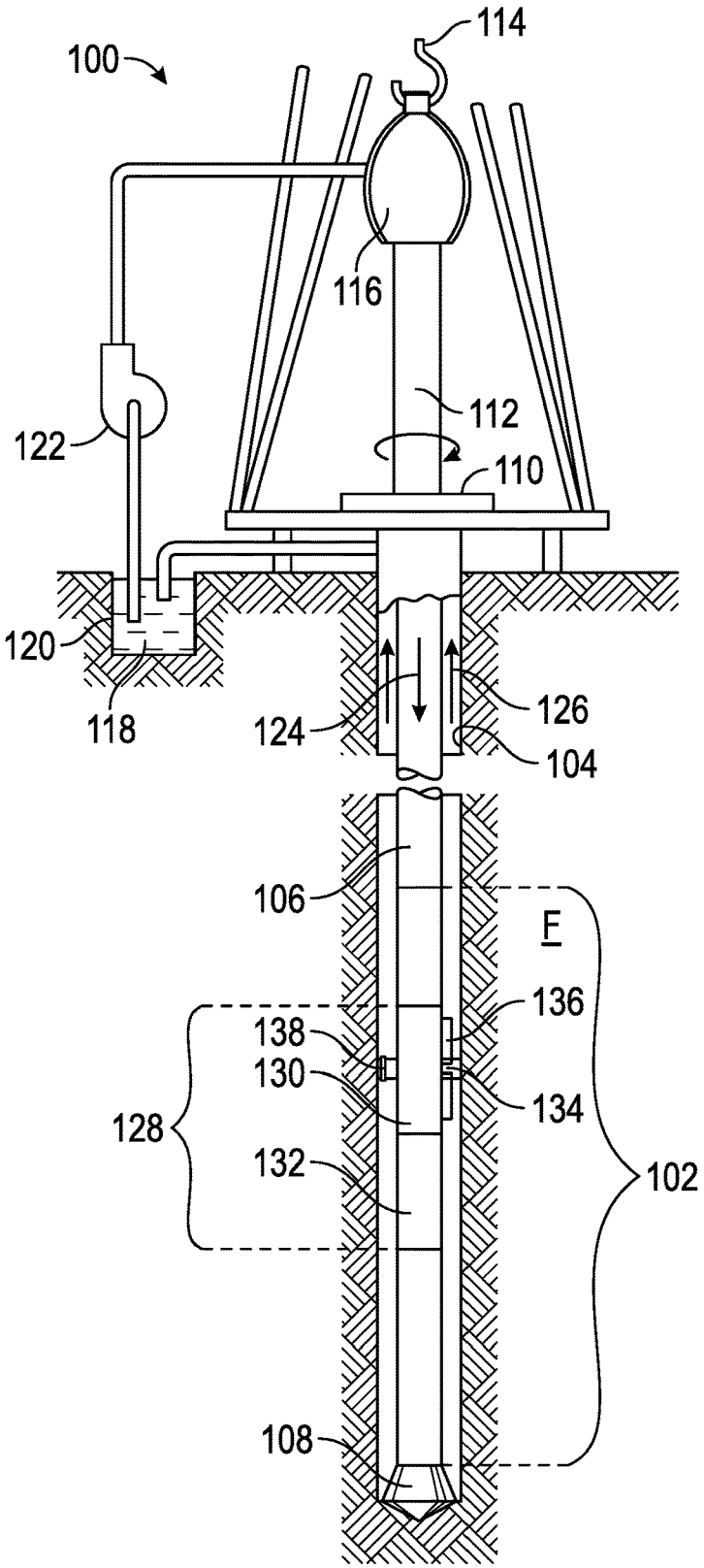
FIG. 1 is a schematic view of an embodiment of a wellsite system that may employ downhole fluid analysis methods, according to aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure relates to systems and methods for formation sampling, such as obtaining a sample using a downhole tool disposed in a wellbore. In certain embodiments, the downhole tool includes a probe assembly that includes several components, namely a probe shoe extendibly mounted to a body of the downhole tool, a packer coupled to the probe shoe, an inlet fixedly coupled to the probe shoe and the packer, and a filter disposed within the inlet. The packer surrounds the inlet and the inlet includes an anti-extrusion ring extending beyond an outer surface of the packer. During operation, the downhole tool is positioned in a wellbore, the probe shoe is extended toward a wall of the wellbore, the outer surface of the packer is contacted against the wall of the wellbore, the wall of the wellbore is penetrated with the anti-extrusion ring, fluid is collected from the wellbore through the inlet, and the fluid is filtered using the filter. Contact of the packer against the wall provides sealing, thereby blocking other fluids in the wellbore from entering the inlet. Thus, the sealing provided by the packer helps the inlet collect formation fluids uncontaminated by other wellbore fluids. In addition, by penetrating into the wall of the wellbore, the anti-extrusion ring helps prevent extrusion, deformation, or movement of the packer into the inlet. In other words, the anti-extrusion ring blocks the packer from entering the inlet. Further, the filter helps block sand and other particles from being absorbed by the downhole tool and provides support to weak or unconsolidated formations. In certain embodiments, a gap between the filter and formation enables mudcake to break when drawdown in applied.

Figure 2:
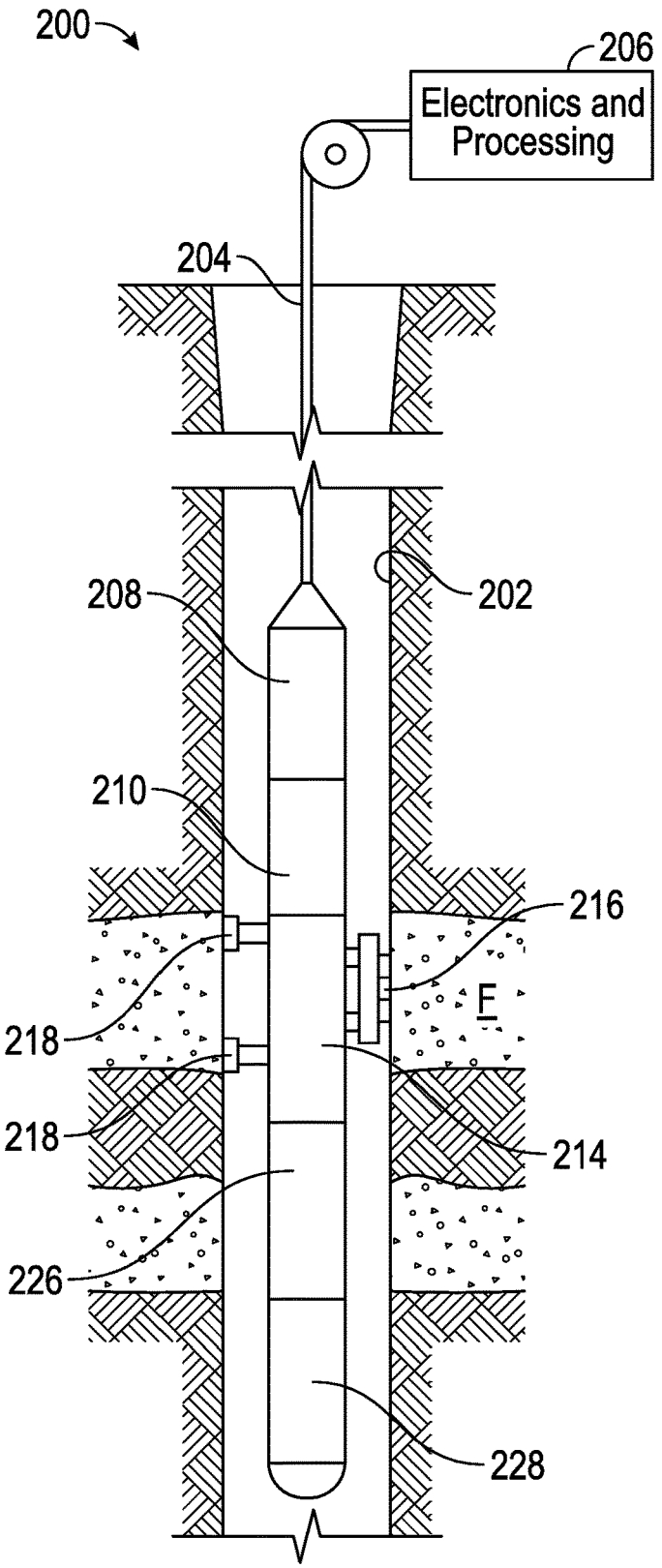
FIG. 2 is a schematic view of another embodiment of a wellsite system that may employ downhole fluid analysis methods, according to aspects of the present disclosure.

FIGS. 1 and 2 depict examples of wellsite systems that may employ the fluid sampling systems and techniques described herein. FIG. 1 depicts a rig 100 with a downhole tool 102 suspended therefrom and into a wellbore 104 via a drill string 106. The downhole tool 100 has a drill bit 108 at its lower end thereof that is used to advance the downhole tool into the formation and form the wellbore. The drillstring 106 is rotated by a rotary table 110, energized by means not shown, which engages a kelly 112 at the upper end of the drillstring 106. The drillstring 106 is suspended from a hook 114, attached to a traveling block (also not shown), through the kelly 112 and a rotary swivel 116 that permits rotation of the drillstring 106 relative to the hook 114. The rig 100 is depicted as a land-based platform and derrick assembly used to form the wellbore 104 by rotary drilling. However, in other embodiments, the rig 100 may be an offshore platform.

Drilling fluid or mud 118 is stored in a pit 120 formed at the well site. A pump 122 delivers the drilling fluid 118 to the interior of the drillstring 106 via a port in the swivel 116, inducing the drilling fluid to flow downwardly through the drillstring 106 as indicated by a directional arrow 124. The drilling fluid exits the drillstring 106 via ports in the drill bit 108, and then circulates upwardly through the region between the outside of the drill string and the wall of the wellbore, called the annulus, as indicated by directional arrows 126. The drilling fluid lubricates the drill bit 108 and carries formation cuttings up to the surface as it is returned to the pit 120 for recirculation.

The downhole tool 102, sometimes referred to as a bottom hole assembly ("BHA"), may be positioned near the drill bit 108 and includes various components with capabilities, such as measuring, processing, and storing information, as well as communicating with the surface. A telemetry device (not shown) also may be provided for communicating with a surface unit (not shown).

The downhole tool 102 further includes a sampling while drilling ("SWD") system 128 including a fluid communication module 130 and a sampling module 132. The modules may be housed in a drill collar for performing various formation evaluation functions, such as pressure testing and sampling, among others. As shown in FIG. 1, the fluid communication module 130 is positioned adjacent the sampling module 132; however the position of the fluid communication module 130, as well as other modules, may vary in other embodiments. Additional devices, such as pumps, gauges, sensor, monitors or other devices usable in downhole sampling and/or testing also may be provided. The additional devices may be incorporated into modules 130 and 132 or disposed within separate modules included within the SWD system 128.

The fluid communication module 130 includes a probe 134, which may be positioned in a stabilizer blade or rib 136. The probe 134 includes one or more inlets for receiving formation fluid and one or more flowlines (not shown) extending into the downhole tool for passing fluids through the tool. In certain embodiments, the probe 134 may include a single inlet designed to direct formation fluid into a flowline within the downhole tool. Further, in other embodiments, the probe may include multiple inlets that may, for example, be used for focused sampling. In these embodiments, the probe may be connected to a sampling flow line, as well as to guard flow lines. The probe 134 may be movable between extended and retracted positions for selectively engaging a wall of the wellbore 104 and acquiring fluid samples from the formation F. One or more setting pistons 138 may be provided to assist in positioning the fluid communication device against the wellbore wall.

FIG. 2 depicts an example of a wireline downhole tool 200 that may employ the systems and techniques described herein. The downhole tool 200 is suspended in a wellbore 202 from the lower end of a multi-conductor cable 204 that is spooled on a winch (not shown) at the surface. The cable 204 is communicatively coupled to an electronics and processing system 206. The downhole tool 200 includes an elongated body 208 that includes a fluid communication module 214 that has a selectively extendable probe 216 and backup pistons 218 that are arranged on opposite sides of the elongated body 208. The extendable probe 216 is configured to selectively seal off or isolate selected portions of the wall of the wellbore 202 to fluidly couple to the adjacent formation F and/or to draw fluid samples from the formation F. The probe 216 may include a single inlet or multiple inlets designed for guarded or focused sampling. Additional modules (e.g., 210) that provide additional functionality such as fluid analysis, resistivity measurements, coring, or imaging, among others, also may also be included in the tool 200.

The formation fluid may be expelled through a port (not shown) or it may be sent to one or more fluid sampling modules 226 and 228. In the illustrated example, the electronics and processing system 206 and/or a downhole control system are configured to control the extendable probe assembly 216 and/or the drawing of a fluid sample from the formation F.

Figure 3:
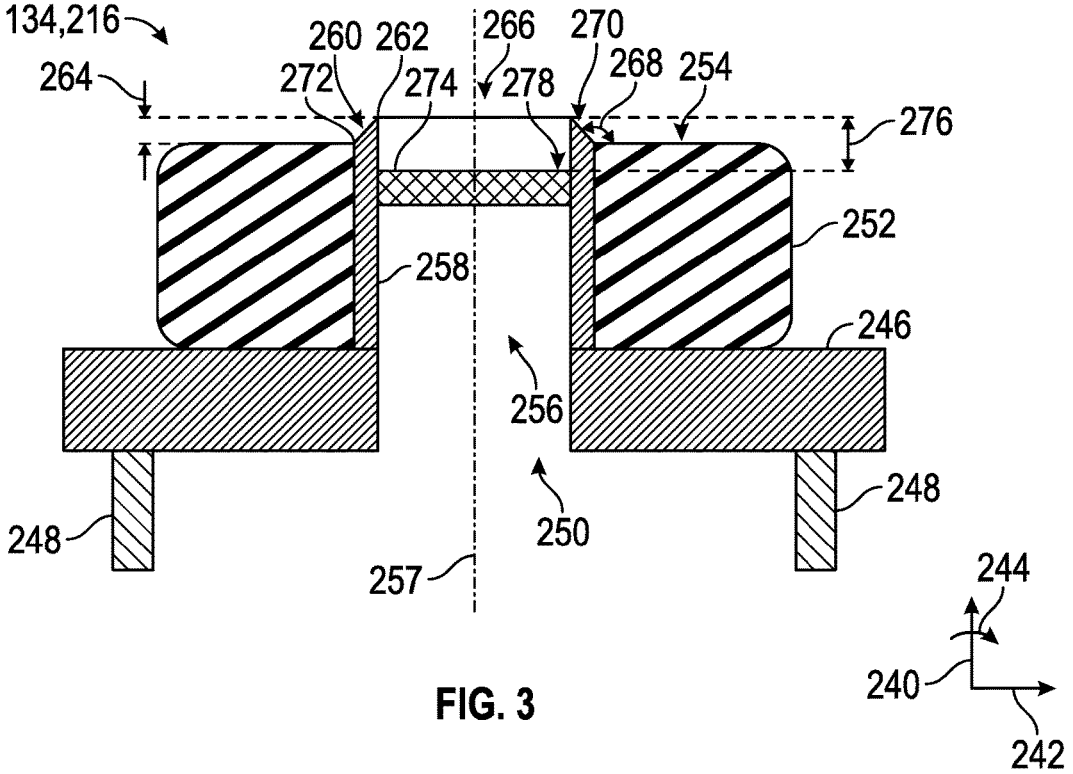
FIG. 3 is a cross-sectional view of a sample probe, according to aspects of the present disclosure.

FIG. 3 is a cross-sectional view of a portion of an embodiment of the probe 134 or 216, which may have an axial axis or direction 240, a radial axis or direction 242, and a circumferential axis or direction 244. The probe 134, 216 may include a probe shoe 246 that supports the other components of the probe 134, 216. In addition, the probe shoe 246 may be coupled to one or more hydraulic pistons 248 to extend or retract the probe 134, 216. The probe shoe 246 may be made from a metal or metal alloy. Further, the probe shoe 246 may include a probe shoe opening 250 to enable flow of the fluid sample through the probe 134, 216. The probe shoe 246 and probe shoe opening 250 may have a variety of shapes, such as, but not limited to, a circular shape, an oval shape, an elongated shape, an elliptical shape, a square shape, a rectangular shape, or a polygonal shape. In certain embodiments, the probe shoe 246 is configured as a circular ring.

As shown in FIG. 3, a packer 252 is coupled to the probe shoe 246. Various methods of attachment including, but not limited to, adhesives, fasteners, and so forth, may be used to couple the packer 252 to the probe shoe 246. The packer 252 made be made from an elastomeric material selected for hydrocarbon based applications, such as nitrile rubber (NBR), hydrogenated nitrile butadiene rubber (HNBR), and fluorocarbon rubber (FKM). When the probe 134, 216 is pressed against the wellbore 104, 202, the packer 252 provides sealing to help block other fluids in the wellbore 104, 202 from entering the probe 134, 216. Thus, the seal provided by the packer 252 helps the probe 134, 216 to collect formation fluid. The packer 252 has an outer surface 254. In the illustrated embodiment, the outer surface 254 is represented as being flat or straight. However, in certain embodiments, the outer surface 254 may be shaped to match a curvature of the wellbore 104, 202, which may improve the sealing provided by the packer 252. Regardless of the shape of the outer surface 254, the elastomeric material used for the packer 252 is compressible, thereby providing an adequate seal for the probe 134, 216. Further, the packer 252 includes a packer opening 256 to enable flow of the fluid sample through the probe 134, 216. Axes of the probe shoe opening 250 and the packer opening 256 may coincide or be coaxial with an axis 257 of the probe 134, 216. The packer 252 and the packer opening 256 may have a variety of shapes, such as, but not limited to, a circular shape, an oval shape, an elongated shape, an elliptical shape, a square shape, a rectangular shape, or a polygonal shape. In certain embodiments, the packer 252 is configured as a circular ring.

The embodiment of the probe 134, 216 shown in FIG. 3 also includes an inlet 258 fixedly coupled to the probe shoe 246 and packer 252. Various methods of attachment including, but not limited to, adhesives, fasteners, welding, brazing, and so forth, may be used to couple the inlet 258 to the probe shoe 246 and packer 252. Because the inlet 258 is fixedly coupled to the probe shoe 246, the inlet 258 does not move separately from the probe shoe 246. In other words, the one or more hydraulic pistons 248 move the probe shoe 246, packer 252, and inlet 258 as one assembly, thereby simplifying construction, operation, and maintenance of the probe 134, 216. The inlet 258 may be made from a metal or metal alloy. The inlet 258 helps route the formation fluid from the wellbore 104, 202 into the downhole tool 102, 200, such as via a flowline coupled to the inlet 258. In addition, the inlet 258 includes an anti-extrusion ring 260. As shown in FIG. 3, the anti-extrusion ring 260 extends beyond the outer surface 254 of the packer 252. For example, an inner edge 262 of the anti-extrusion ring 260 may extend a distance 264 from the outer surface 254. Thus, when the probe 134, 216 is pressed against the wellbore 104, 202, the anti-extrusion ring 260 may penetrate into the wellbore 104, 202 by up to the distance 264. The penetration of the anti-extrusion ring 260 into the wellbore 104, 202 helps block the packer 252 from extruding or deforming into an inlet opening 266, which may help prevent wear and increase the longevity of the packer 252. Further, the anti-extrusion ring 260 may be characterized by an angle 268 between the outer surface 254 of the packer 252 and an outer surface 270 of the anti-extrusion ring 260. In certain embodiments, the angle 268 may be less than approximately 135 degrees. In other words, there is a discontinuity at an interface 272 between the packer 252 and the anti-extrusion ring 260. As shown in FIG. 3, the outer surface 254 of the packer does not follow the same contour as the outer surface 270 of the anti-extrusion ring 260. Otherwise, the anti-extrusion ring 260 would not penetrate into the wellbore 104, 202.

In the illustrated embodiment, the outer surface 270 is represented as being flat or straight, but in other embodiments, the outer surface 270 may be curved or have other shapes. Further, inlet opening 266 enables flow of the fluid sample through the probe 134, 216 from the wellbore 104, 202. An axis of the inlet opening 266 may coincide or be coaxial with axes of the probe shoe opening 250 and the packer opening 256. The inlet 258 and inlet opening 266 may have a variety of shapes, such as, but not limited to, a circular shape, an oval shape, an elongated shape, an elliptical shape, a square shape, a rectangular shape, or a polygonal shape. In certain embodiments, the inlet 258 is configured as a circular tube or cylinder. In further embodiments, the inlet 258 may be an extension of the probe shoe 246. In other words, rather than two separate components coupled together, the inlet 258 may be formed from the same metal or metal alloy used to form the probe shoe 246.

In the illustrated embodiment, a filter 274 is disposed within the inlet 258. More specifically, the filter 274 is located within the inlet opening 266. The filter 274 may be used to filter the formation fluid and a variety of filtering media, such as screens, slots, holes, or other openings, or filtering techniques may be used for the filter 274. As shown in FIG. 3, a gap 276 may exist between the filter 274 and the anti-extrusion ring 260. More specifically, the gap 276 may be measured from an outer surface 278 of the filter 274 and the inner edge 262 of the anti-extrusion ring 260. The gap 276 may enable the filter 274 to support the formation during sampling, which may be helpful when the formation is weak or unconsolidated. In addition, the presence of the gap 276 may enable mudcake along the wellbore 104, 202 to break up when drawdown is applied by the probe 134, 216. In certain embodiments, the filter 274 may be disposed perpendicular to a direction of flow through the inlet 258. In other words, the outer surface 278 of the filter 274 is perpendicular to the axis of the inlet 258.

Figure 4:
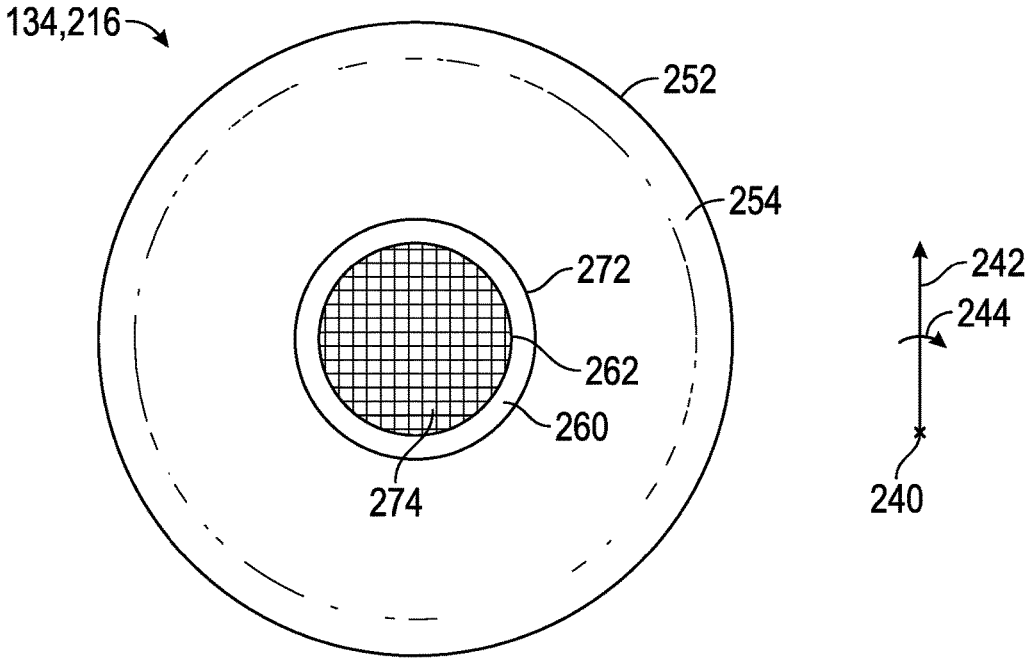
FIG. 4 is a front view of a sample probe, according to aspects of the present disclosure.

FIG. 4 is a front view of an embodiment of the probe 134, 216. As shown in FIG. 4, the packer 252 surrounds the anti-extrusion ring 260, which surrounds the filter 274. Both the packer 252 and the anti-extrusion ring 260 are configured as rings and the filter 274 has a circular shape. As discussed above, the probe 134, 216 may have other shapes to suit different formations, formation conditions, and sampling objectives.

Figure 5:
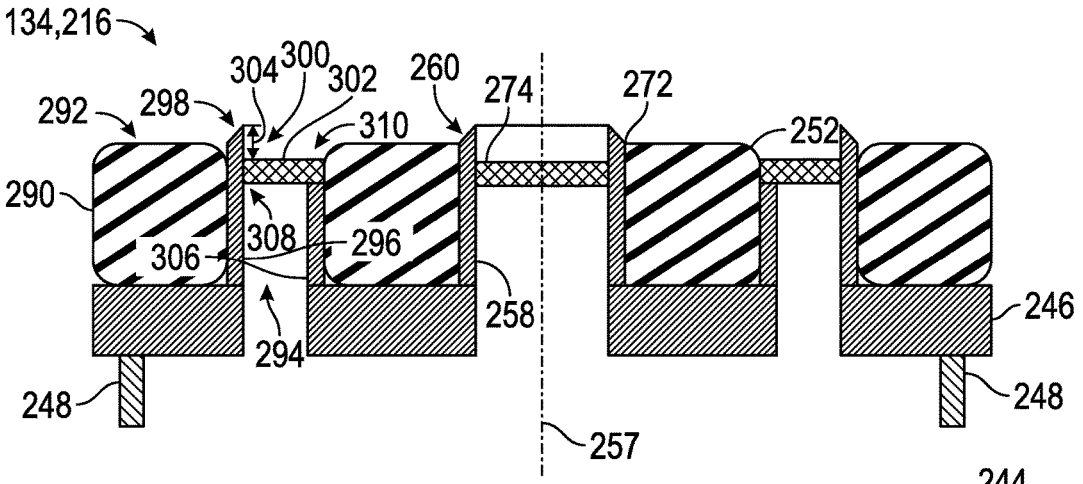
FIG. 5 is a cross-sectional view of a guarded sample probe, according to aspects of the present disclosure.

FIG. 5 is a cross-sectional view of a guarded probe 134, 216. As discussed above, the probe 134, 216 may include multiple inlets that may, for example, be used for guarded or focused sampling. In these embodiments, the probe 134, 216 may be connected to a sampling flow line, as well as to guard flow lines. As shown in FIG. 5, a guard packer 290 is coupled to the probe shoe 246. Various methods of attachment including, but not limited to, adhesives, fasteners, and so forth, may be used to couple the guard packer 290 to the probe shoe 246. The guard packer 290 made be made from an elastomeric material selected for hydrocarbon based applications, such as nitrile rubber (NBR), hydrogenated nitrile butadiene rubber (HNBR), and fluorocarbon rubber (FKM). When the probe 134, 216 is pressed against the wellbore 104, 202, the guard packer 290 provides sealing to help block other fluids in the wellbore 104, 202 from entering the probe 134, 216. The guard packer 290 has a guard outer surface 292. In the illustrated embodiment, the guard outer surface 292 is represented as being flat or straight. However, in certain embodiments, the guard outer surface 292 may be shaped to match a curvature of the wellbore 104, 202, which may improve the sealing provided by the guard packer 290. Regardless of the shape of the guard outer surface 292, the elastomeric material used for the guard packer 290 is compressible, thereby providing an adequate seal for the probe 134, 216. Further, the guard packer 290 includes a guard packer opening 294 to enable flow of the fluid sample through the probe 134, 216. An axis of the guard packer opening 294 may coincide or be coaxial with the axis 257 of the probe 134, 216. The guard packer 290 and the guard packer opening 294 may have a variety of shapes, such as, but not limited to, a circular shape, an oval shape, an elongated shape, an elliptical shape, a square shape, a rectangular shape, or a polygonal shape. In certain embodiments, the guard packer 290 is configured as a circular ring.

The embodiment of the probe 134, 216 shown in FIG. 5 also includes a guard inlet 296 fixedly coupled to the probe shoe 246 and guard packer 290. Various methods of attachment including, but not limited to, adhesives, fasteners, welding, brazing, and so forth, may be used to couple the guard inlet 296 to the probe shoe 246 and guard packer 290. Because the guard inlet 296 is fixedly coupled to the probe shoe 246, the guard inlet 296 does not move separately from the probe shoe 246. In other words, the one or more hydraulic pistons 248 move the probe shoe 246, guard packer 290, and guard inlet 296 as one assembly, thereby simplifying construction, operation, and maintenance of the probe 134, 216. In other embodiments, the probe 134, 216 may include two probe shoes 246 with one for the sampling assembly (e.g., packer 252 and inlet 258) and another for the guard assembly (e.g., guard packer 290 and guard inlet 296). In such embodiments, each of the two probe shoes 246 may include separate hydraulic pistons 248 to enable the sampling and guard assemblies to be move independently of one another. The guard inlet 296 may be made from a metal or metal alloy. The guard inlet 296 helps route the formation fluid from the wellbore 104, 202 into the downhole tool 102, 200. In addition, the guard inlet 296 includes a guard anti-extrusion ring 298. As shown in FIG. 5, the guard anti-extrusion ring 298 extends beyond the outer surface 292 of the guard packer 290 in a similar manner as the anti-extrusion ring 260. Thus, when the probe 134, 216 is pressed against the wellbore 104, 202, the guard anti-extrusion ring 298 may penetrate into the wellbore 104, 202. The penetration of the guard anti-extrusion ring 260 into the wellbore 104, 202 helps block the guard packer 290 from extruding or deforming into a guard inlet opening 300, which may help prevent wear and increase the longevity of the guard packer 290. In other respects, the guard anti-extrusion ring 298 is similar to the anti-extrusion ring 260 described in detail above.

In the illustrated embodiment, a guard filter 302 is disposed within the guard inlet 296. More specifically, the guard filter 302 is located within the guard inlet opening 300. The guard filter 302 may be used to filter the formation fluid and a variety of filtering media, such as screens, slots, holes, or other openings, or filtering techniques may be used for the guard filter 302. As shown in FIG. 5, a guard gap 304 may exist between the guard filter 302 and the guard anti-extrusion ring 298. The guard gap 304 may enable the guard filter 302 to support the formation during sampling, which may be helpful when the formation is weak or unconsolidated. In addition, the presence of the guard gap 304 may enable mudcake along the wellbore 104, 202 to break up when drawdown is applied by the probe 134, 216. In certain embodiments, the guard filter 302 may be disposed perpendicular to a direction of flow through the inlet 258.

In certain embodiments, the probe 134, 216 may include a packer support 306 when guarded embodiments are used. The packer support 306 may help block the packer 252 from extruding or deforming into the guard inlet 296 during operation of the probe 134, 216. As shown in FIG. 5, an outer edge 308 of the guard filter 302 is supported via the guard inlet 296. An inner edge 310 of the guard filter 302 may be supported via the packer 252 and/or packer support 306. The packer support 306 may be coupled to the probe shoe 246 or be formed from the probe shoe 246 in a similar manner as the inlet 258.

Figure 6:
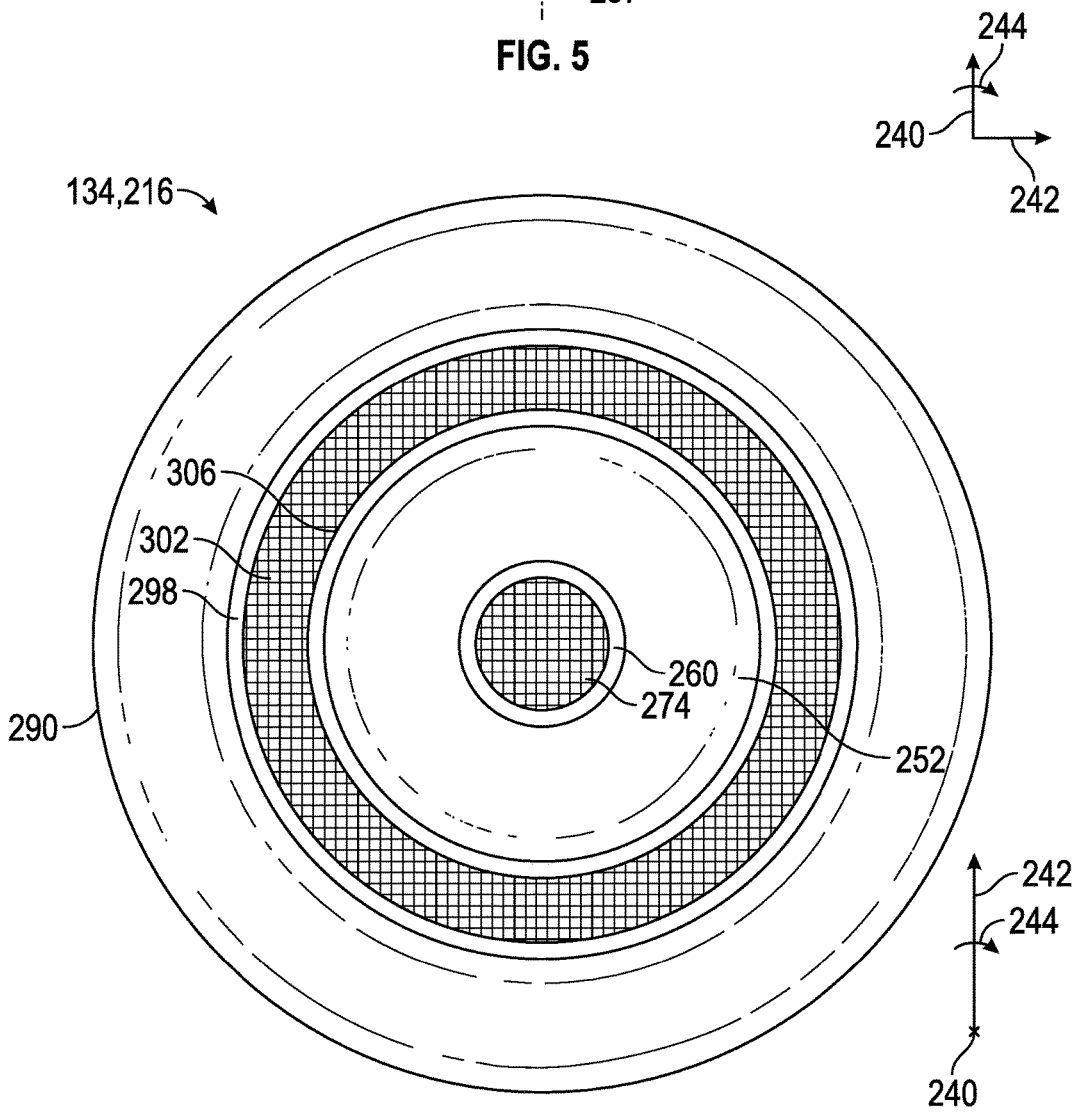
FIG. 6 is a front view of a guarded sample probe, according to aspects of the present disclosure.

FIG. 6 is a front view of an embodiment of the probe 134, 216. As shown in FIG. 6, the packer 252 surrounds the anti-extrusion ring 260, which surrounds the filter 274. In addition, the guard packer 290 surrounds the guard anti-extrusion ring 298, which surrounds the guard filter 302. In the illustrated embodiment, the guard filter 302 is supported by the guard anti-extrusion ring 298 and the packer support 306, so the packer support 306 is shown surrounding the packer 252. The guard packer 290, guard anti-extrusion ring 298, and guard filter 302 are configured as rings. In addition, the packer support 306 is configured as a ring when used. As discussed above, the probe 134, 216 may have other shapes to suit different formations, formation conditions, and sampling objectives. In addition, FIG. 6 shows how focused sampling may be achieved. First, the guard packer 290 helps block other fluids in the wellbore 104, 202 from entering the probe 134, 216. The packer 252 establishes two zones, namely an inner sampling zone and an outer guard zone. Fluid collected in the inner sampling zone passes through the filter 274 and is relatively less contaminated by filtrate than fluid collected in the outer guard zone that passes through the guard filter 302. Thus, focused sampling may be used to achieve more representative samples of formation fluid in a less time than non-focused sampling.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A system, comprising:

a formation sampling tool having a body;

a probe shoe extendibly mounted to the body;

a packer coupled to the probe shoe;

an inlet fixedly coupled to the probe shoe and the packer, wherein the packer surrounds the inlet and the inlet comprises an anti-extrusion ring extending beyond an outer surface of the packer; and a filter disposed within the inlet, wherein the system further comprises a guard packer coupled to the probe shoe;

a guard inlet fixedly coupled to the probe shoe and the guard packer, wherein the guard packer surrounds the guard inlet, the guard inlet surrounds the packer, and the guard inlet comprises a guard anti-extrusion ring extending beyond an outer surface of the guard packer; and a guard filter disposed within the guard inlet.

2. The system of claim 1, comprising a discontinuity at an interface between the packer and the anti-extrusion ring.

3. The system of claim 1, wherein an angle between the outer surface and the anti-extrusion ring is less than approximately 135 degrees.

4. The system of claim 1, wherein the filter is configured to support a portion of a formation.

5. The system of claim 1, comprising a gap between the filter and the anti-extrusion ring.

6. The system of claim 1, wherein the filter is disposed perpendicular to a direction of flow through the inlet.

7. The system of claim 1, comprising a hydraulic piston coupled to the probe shoe, wherein the hydraulic piston is configured to extend and retract the probe shoe.

8. The system of claim 7, wherein the hydraulic piston is configured to extend and retract the probe shoe, packer, inlet, and filter as one assembly.

9. The system of claim 1, wherein the outer surface of the packer is shaped to match a curvature of a wellbore wall of a formation.

10. The system of claim 1, wherein the inlet and packer comprise a circular shape, an oval shape, an elongated shape, an elliptical shape, a square shape, a rectangular shape, or a polygonal shape.

11. The system of claim 1, wherein the formation sampling tool is configured for conveyance within a wellbore by at least one of a wireline or a drillstring.

12. A method, comprising:

providing a formation sampling tool having a probe shoe extendibly mounted to a body of the formation sampling tool, a packer coupled to the probe shoe, an inlet fixedly coupled to the probe shoe and the packer, wherein the packer surrounds the inlet and the inlet comprises an anti-extrusion ring extending beyond an outer surface of the packer, and a filter disposed within the inlet, wherein the formation sampling tool further comprising a guard packer coupled to the probe shoe, a guard inlet fixedly coupled to the probe shoe and the guard packer, wherein the guard packer surrounds the guard inlet, the guard inlet surrounds the packer, and the guard inlet comprises a guard anti-extrusion ring extending beyond an outer surface of the guard packer, and a guard filter disposed within the guard inlet;

positioning the formation sampling tool in a wellbore;

extending the probe shoe toward a wall of the wellbore;

contacting the outer surface of the packer against the wall of the wellbore and contacting the outer surface of the guard packer against the wall of the wellbore;

penetrating the wall of the wellbore with the anti-extrusion ring and the guard anti-extrusion ring;

collecting fluid from the wellbore through the inlet and collecting contaminated fluid from the wellbore through the guard inlet; and filtering the fluid using the filter and filtering the contaminated fluid using the guard filter.

13. The method of claim 12, comprising supporting a portion of the wall using the filter.

14. The method of claim 12, wherein a gap between the filter and the anti-extrusion ring is configured to enable mudcake to break when fluid is collected.

15. The method of claim 12, comprising extending the probe shoe toward the wall using a hydraulic piston.

16. The method of claim 15, comprising extending and retracting the probe shoe, packer, inlet, and filter as one assembly using the hydraulic piston.

* * * * *